United States Patent [19]

Ray

[11] 4,022,093

[45] May 10, 1977

[54] DRUM OPENING AND CLOSING MECHANISM

[75] Inventor: Eric Thomas Ray, Andover, England

[73] Assignee: AMF Incorporated, White Plains, N.Y.

[22] Filed: Apr. 6, 1976

[21] Appl. No.: 674,252

[30] Foreign Application Priority Data

Apr. 17, 1975 United Kingdom ..... 15841/75

[52] U.S. Cl. ..... 83/355; 83/860; 241/282.1; 51/249

[51] Int. Cl.[2] ..... B26D 7/22

[58] Field of Search ..... 83/355, 356.3, 478, 83/544, 860; 241/222, 223, 231, 232, 282.1, 277; 51/249

[56] References Cited

UNITED STATES PATENTS

| | | | |
|---|---|---|---|
| 2,476,177 | 7/1949 | Bloom et al. | 51/249 X |
| 3,939,746 | 2/1976 | Rogers et al. | 83/478 X |

*Primary Examiner*—Willie G. Abercrombie
*Attorney, Agent, or Firm*—George W. Price; Charles J. Worth

[57] ABSTRACT

An opening and closing mechanism for the casing of a machine, especially a tobacco cutting machine is provided, having a pair of meshing gears mounted on one machine part, which by way of a link-mechanism are adapted to rotate when the casing is opened. A shock absorber is mounted between the gears to enable the opening movement to have a first phase which is relatively unimpeded and a second phase is damped.

6 Claims, 3 Drawing Figures

DRUM OPENING AND CLOSING MECHANISM

BACKGROUND TO THE INVENTION

This invention relates to an opening and closing mechanism, particularly the drum opening and closing mechanism of the tobacco cutter machine described in U.S. Pat. No. 3,328,924 granted July 4, 1967 to H. Ward for Apparatus for Sharpening Rotary Cutters, and U.S. applications Ser. No. 674,468 and Ser. No. 674,338; the foregoing patent and applications being assigned to the same assignee as the present application.

OBJECTS OF THE INVENTION

An object of this invention is to enable the drum casing of a tobacco cutter machine to be opened, in particular for maintainance purposes, securely and safely. It is a further object of this invention to provide an opening movement for the casing of a tobacco cutter machine, where the initial phase of the movement is relatively free but the final phase of movement is cushioned

SUMMARY OF THE INVENTION

According to the invention there is provided in a machine having a stationary first part and a movable second part pivotally mounted on the first part and capable of movement between a closed position where the two parts are closely adjacent each other and an open position, the provision of an opening and closing mechanism comprising:

a. an actuator device having an output shaft, mounted on the first part;
b. a first link connected at one end to the output shaft;
c. a second link pivotally connected at one end to the other end of said first link and pivotally connected at its other end to said second part;
d. first and second elements respectively mounted on the output shaft and the first part, said elements being coupled in such a manner that they are mutually contra-rotatable; and
e. a shock absorber connected between eccentric points on said first and second elements, said shock absorber effecting damping as the distance between said eccentric points decreases in operation.

In the particularly preferred application of this invention, the first machine part carries a rotating cutter drum and said second machine part carries means for feeding tobacco to said cutter drum to cut the tobacco.

Preferably, the elements are meshing circular gears, and each have teeth over only part of their circumference.

In a preferred embodiment the actuator for moving said first link is a pneumatically driven quadrant actuator.

The second gear may be coupled to a return spring and the pneumatic shock absorber may be of the type which offers a relatively high resistance to contraction and a relatively low resistance to expansion.

BRIEF DESCRIPTION OF THE DRAWINGS

A constructional embodiment of the invention will now be described, purely by way of example, with reference to the accompanying drawings in which.

DESCRIPTION OF PREFERRED EMBODIMENT

Figure 1:
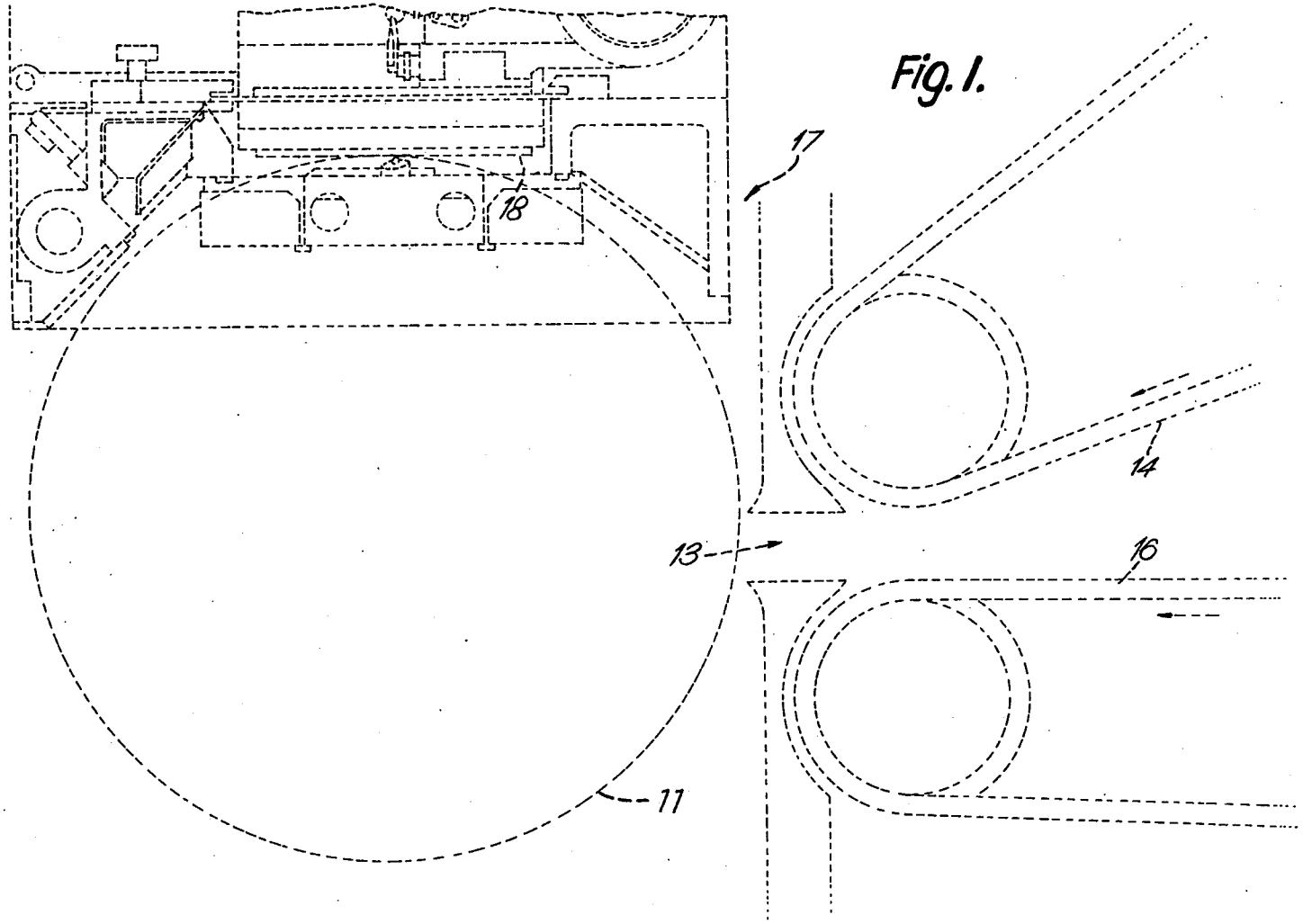
FIG. 1 is a right hand side view of part of a tobacco cutting machine showing the position of a grinding unit and a tobacco feed mechanism associated with a cutter drum.

As shown in FIG. 1, the tobacco cutting machine comprises a rotating cutting drum 11 to which tobacco is fed via a mouthpiece 13 by means of upper and lower conveyors 14 and 16. Above the cutter drum is mounted a grinding unit generally represented by 17 which includes a rotating grinding wheel 18 for grinding the knives of the cutter drum. The grinding unit is the subject of copending U.S. application Ser. No. 674,338.

Figure 2:
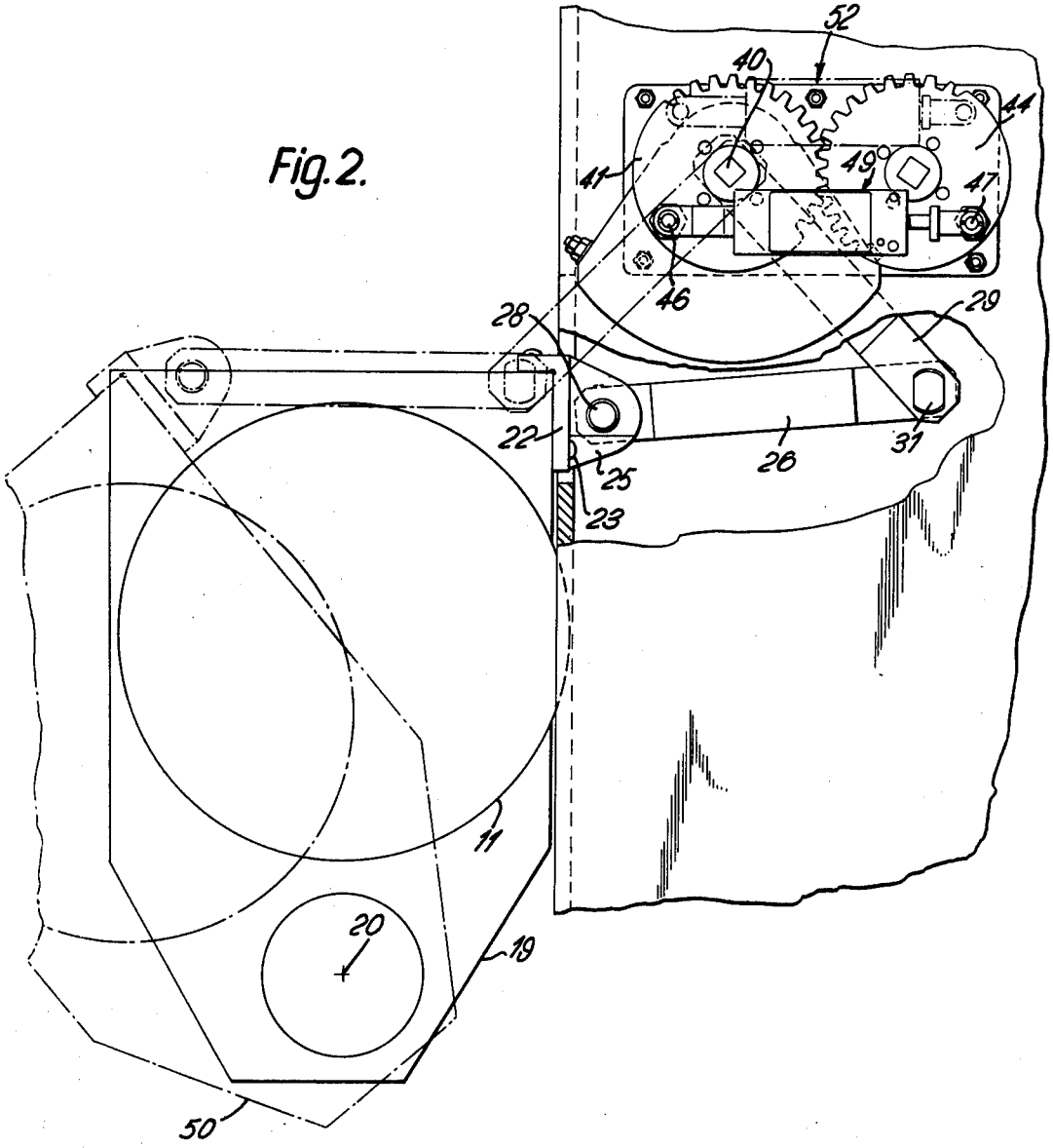
FIG. 2 shows the opening and closing mechanism according to the invention.
Figure 3:
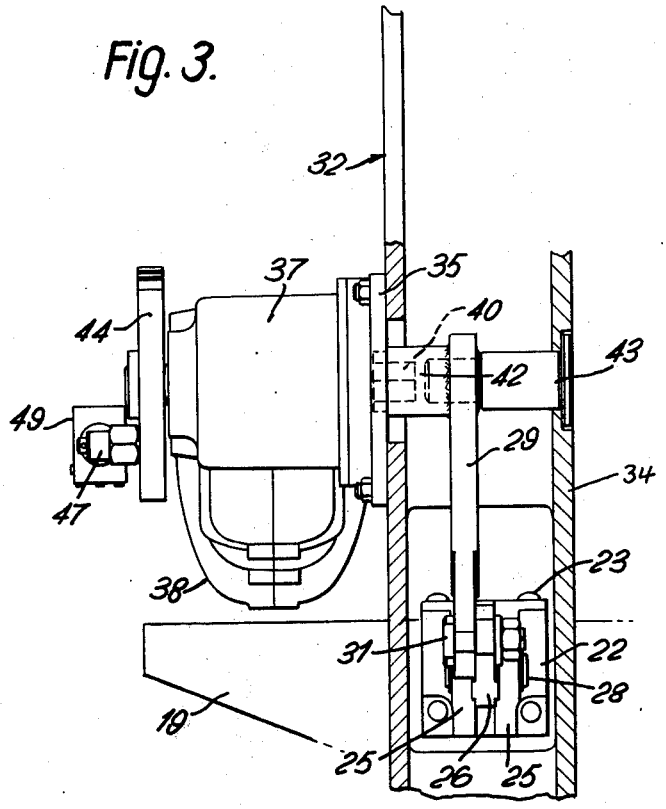
FIG. 3 is a rear view of the opening and closing mechanism shown in FIG. 2.

The mouthpiece 13, and the conveyors 14 and 16 are supported in known manner within the housing of the machine, details of which housing do not directly concern the present invention. Referring to FIG. 2, the cutter drum is mounted for rotation in an assembly 19 which is pivoted to the machine housing for movement about an axis 20. To give an indication of size, the distance of the centre of the cutter drum to the axis 20 is 400mm. Pivot blocks 22 are secured one to each side of the cutter drum assembly 19 by means of bolts 23 (see also FIG. 3). Each pivot block comprises a pair of lugs 25 disposed parallel to each other. One end of a link 26 is mounted on a pivot pin 28 which passes through the lugs 25 of the pivot block 22. The other end of the link 26 is articulated to one end of a further link 29 by way of a pivot 31. The housing of the machine includes two plates 32 and 34 between which the articulated links 26 and 29 are arranged.

A plate 35 is bolted on the face of housing plate 32 remote from the aritculated links, and supports a casing containing a return coil spring 37 and a pneumatically driven quadrant actuator 38 which may be the Kinetrol Model E having a torque of 12000 lb'' at 100 p.s.i. Compressed air may be supplied to the actuator by means (not shown) well known in the art. One end of operating shaft 40 of the actuator 38 is fixed to a gear 41 which carries teeth over only 180° of its circumference. The other end of the shaft 40 extends through the plate 32 and is coupled by means of a shaft 42 welded to one end of the link 29, the latter also being supported on a pin 43 mounted in the housing plate 34.

The operating shaft of the return coil spring 37 also carries a gear 44 which is similar to, and meshes with, the gear 41.

The return coil spring 37 may be of the Kinetrol Type - 3C having a rating of 2300 lb. ins. in the drum closed position, and 2700 lb. ins. in the drum open position.

Eccentrically mounted on each gear 41, 44 is a pin 46, 47 and extending therebetween is a piston and cylinder shock absorber 49 of the type which offers a high resistance to contraction as compared to a relatively low resistance to expansion. The shock absorber may, for example, be a SHOK-BLOC (Trade Mark) as manufactured by Kinetrol Limited, Farnham, Surrey, England.

As shown in the drawings the full lines show the closed position of the mechanism. When the quadrant actuator 38 is actuated by supplying compressed air to the opening side thereof the gears 41, 44 rotate allowing the cutter drum/grinder assembly to pivot about the axis 20 until the position shown by the broken lines 50 is reached corresponding to an opening angle of 40°. The shock absorber 49 occupies the position shown by the broken lines 52. It will be clearly seen that during this opening movement the distance between the mounting points of the shock absorber 49 on the gears (constituted by the pins 46, 47) at first increases, and then decreases again. Because the shock absorber 49 offers resistance only when it is closing, the final phase of the drum/grinder assembly opening movement is damped, while the first phase of the opening movement is relatively unimpeded. Thus, a speedy opening of the casing can be achieved without the opening movement coming to such an abrupt end that the rest of the machine parts are disturbed.

Closing of the machine casing from the open position again causes the distance between the pins 46, 47 to initially increase and then decrease with a similar effect, the final phase of the closing movement being damped.

The return coil spring 37 has the effect of holding the drum grinder assembly in the safer closed position should an air failure occur.

It is preferred to regulate the air pressure to the opening side of the actuator 38 so that initial movement of the drum/grinder assembly away from the mouth piece is very slow. A safety valve may be incorporated in the associated pneumatic circuit so that the air supply to the closing side of the actuator 38 can be cut off when personnel are working around the mouthpiece area.

I claim:

1. In a machine having a stationary first part and a movable second part pivotally mounted on the first part and capable of movement between a closed position where the two parts are closely adjacent each other and an open position, the provision of an opening and closing mechanision comprising:

a. an actuator device having an output shaft, mounted on the first part;

b. a first link connected at one end to the output shaft;

c. a second link pivotally connected at one end to the other end of said first link and pivotally connected at its other end to said second part;

d. first and second elements respectively mounted on the output shaft and the first part, said elements being coupled in such a manner that they are mutually contra-rotatable; and e. a shock absorber connected between eccentric points on said first and second elements, said shock absorber effecting damping as the distance between said eccentric points decreases in operation.

2. A machine according to claim 1 wherein said elements have meshing teeth.

3. A machine according to claim 1 wherein said actuator for moving said first link comprises a pneumatically driven quadrant actuator.

4. A machine according to claim 1 having a return spring coupled to said second element.

5. A machine according to claim 1 wherein said first machine part carries a rotating cutter drum and said second machine part carries means for feeding tobacco to said cutter drum to cut the tobacco.

6. A machine according to claim 1 wherein said pneumatic shock absorber offers a relatively high resistance to contraction and a relatively low resistance to expansion.

* * * * *